US008024917B2

(12) United States Patent
Hruby et al.

(10) Patent No.: US 8,024,917 B2
(45) Date of Patent: Sep. 27, 2011

(54) MULTI-FUNCTIONAL POWER SUPPLY FOR A HALL THRUSTER

(75) Inventors: Vladimir J. Hruby, Newton, MA (US); Bruce M. Pote, Sturbridge, MA (US); Lawrence Byrne, Cranston, RI (US); William Connolly, Dover, MA (US)

(73) Assignee: Busek Company, Natick, MA (US)

( * ) Notice: Subject to any disclaimer, the term of this patent is extended or adjusted under 35 U.S.C. 154(b) by 1941 days.

(21) Appl. No.: 10/761,565

(22) Filed: Jan. 22, 2004

(65) Prior Publication Data

US 2004/0150347 A1 Aug. 5, 2004
US 2010/0207527 A1 Aug. 19, 2010

Related U.S. Application Data

(60) Provisional application No. 60/442,483, filed on Jan. 24, 2003.

(51) Int. Cl.
*F03H 1/00* (2006.01)

(52) U.S. Cl. ..... 60/202; 60/203.1; 315/111.01

(58) Field of Classification Search ..... 60/202, 60/203.1; 315/111.01
See application file for complete search history.

(56) References Cited

U.S. PATENT DOCUMENTS 6,031,334 A 2/2000 Meyer
6,518,693 B1 * 2/2003 Meyer et al. ..... 313/359.1
6,834,492 B2 * 12/2004 Hruby et al. ..... 60/202

* cited by examiner

*Primary Examiner* — Christopher P Ellis
(74) *Attorney, Agent, or Firm* — Laniorio Teska & Coleman

(57) ABSTRACT

A multi-functional power supply system for a Hall thruster including a thruster assembly for providing a plasma discharge and a cathode assembly for providing electrons. The cathode assembly includes an emitter, a keeper with a current limiting device, and a heater. A magnetic field source is operatively associated with the cathode assembly for generating a magnetic field to control the discharge. A plasma discharge circuit creates a plasma and accelerates the plasma to produce thrust. A power supply is connected to the keeper and the plasma discharge circuit and is connected to the heater through a switching device responsive to a predetermined condition for interrupting the power to the heater and simultaneously enabling the power supply to deliver power to the keeper and the plasma discharge circuit to initiate production of thrust.

19 Claims, 4 Drawing Sheets

MULTI-FUNCTIONAL POWER SUPPLY FOR A HALL THRUSTER

RELATED APPLICATIONS

This application claims priority of U.S. Provisional Application No. 60/442,483 filed Jan. 24, 2003 entitled "Simplified Power Processor For Distributing Power In An Electric Thruster", incorporated by reference herein.

FIELD OF THE INVENTION

This invention relates to Hall thruster systems and more particularly to a multi-functional power supply for a Hall thruster.

BACKGROUND OF THE INVENTION

A conventional Hall thruster propulsion system includes, inter alia, a thruster assembly, including magnetic field source (s), a cathode assembly including an emitter, a heater, and a keeper, a propellant storage and delivery system, and a power processing unit (PPU) to power the plasma discharge circuit and to selectively distribute power to the various system components.

Prior PPUs of Hall thrusters typically include separate power supplies for the keeper, the heater, the magnetic source, and the plasma discharge circuit. Typically, the PPU has the largest volume and largest mass of all components in the Hall thruster system. Reducing the size of the PPU by combining and/or eliminating one or more of the various power supplies for the keeper ignition, the heater, the magnetic source, or plasma discharge circuit is one way to reduce the overall size and weight of the Hall thruster system.

One attempt to overcome the problems associated with the separate power supplies of the PPU is disclosed in U.S. Pat. No. 6,031,334 entitled "Method And Apparatus For Selectively Distributing Power In A Thruster System", incorporated by reference herein. The '334 patent discloses a PPU which includes power supply coupled to a power distribution circuit which selectively provides power to the heater, keeper, and magnetic field source. The power distribution circuit is specifically located between the power supply and the heater, the keeper, and magnetic field source. This design of the distribution circuit does not supply power to the plasma discharge, hence the '334 method and apparatus as disclosed in the '334 patent requires a separate power supply for the plasma discharge, as well as complicated electronics associated with the distribution circuit, which both add mass and volume to the Hall thruster system.

BRIEF SUMMARY OF THE INVENTION

It is therefore an object of this invention to provide an improved multi-functional power supply for a Hall thruster.

It is a further object of this invention to provide such a multi-functional power supply which decreases the weight of the Hall thruster system.

It is a further object of this invention to provide such a multi-functional power supply which decreases the volume of the Hall thruster system.

It is a further object of this invention to provide such a multi-functional power supply which eliminates the need for a distribution circuit and its associated electronics.

It is a further object of this invention to provide such a multi-functional power supply which can operate the heater, the keeper, the magnetic field source, and the plasma discharge.

It is a further object of this invention to provide such a multi-functional power supply which eliminates the need for a separate power supply for the plasma discharge circuit.

It is a further object of this invention to provide such a multi-functional power supply which eliminates the need for a cathode keeper ignition circuit.

It is a further object of this invention to provide such a multi-functional power supply which can operate in both voltage or current control mode.

The invention results from the realization that a truly innovative multi-functional power supply system for a Hall thruster can be achieved by one power supply connected to the keeper, the plasma discharge circuit, the magnetic source, and the cathode heater through a switching device. The power supply operates in a current limiting mode when the switching device is closed and delivering maximum current to the cathode heater and operates the power supply in a voltage control mode when the switching device is open and delivering voltage to the keeper, and the plasma discharge circuit connected in series with the magnetic field source for the production of the thrust.

This invention features a multi-functional power supply system for a Hall thruster including a thruster assembly for providing a plasma discharge and a cathode assembly for providing electrons. The cathode assembly includes an emitter, a keeper having a current limiting device, and a heater. A magnetic field source operatively is associated with the thruster assembly for generating a magnetic field to control the discharge. A plasma discharge circuit creates a plasma and accelerates the plasma to produce thrust. A power supply is connected to the keeper and the plasma discharge circuit and is connected to the heater through a switching device responsive to a predetermined condition for interrupting the power to the heater and simultaneously enabling the power supply to deliver power to the keeper and the plasma discharge circuit to initiate production of thrust.

In one embodiment, the magnetic field source may be in series with the discharge circuit and powered by the power supply. The thruster assembly may include an anode in series with the magnetic field source. The magnetic field source may include permanent magnets. The system may include a monitoring system for activating the switching device when a predetermined condition occurs. The predetermined condition may be temperature and the monitoring system may include a temperature sensor. The predetermined condition may be time and the monitoring system may include a timing circuit. The predetermined condition may be voltage and the monitoring system may include a voltage sensor. The power supply may operate in a current control mode when the switching device is closed and conducting current to the heater and in a voltage control mode when the switching device is open and interrupting the current to the heater. The current limiting device may include a resistor for selecting the operating point for the keeper. The current limiting device may be non-dissipative. The current limiting device may include a second switching device for interrupting current to the keeper. The multi-functional power supply system may include a switching device for regulating current through the magnetic field source for regulating plasma discharge impedance.

This invention further features a multi-functional power supply system for a Hall thruster including a thruster assembly including an anode for providing a plasma discharge and a cathode assembly for providing electrons. The cathode assembly includes an emitter, a keeper including a current limiting device, and a heater. A magnetic field source is operatively associated with the thruster assembly for generating a magnetic field to control the discharge. A plasma discharge circuit creates a plasma and accelerates the plasma to produce thrust. A power supply is connected to the keeper and the plasma discharge circuit and is connected to the heater through a switching device responsive to a predetermined condition for interrupting the power to the heater and simultaneously enabling the power supply to deliver power to the keeper and the discharge circuit to initiate production of thrust. The power supply operates in a current control mode when the switching device is conducting current and in a voltage control mode when the switching device has interrupted the current to the heater.

This invention also features a multi-functional power supply system for a Hall thruster including a thruster assembly for providing a plasma discharge and a cathode assembly for providing electrons. The cathode assembly includes an emitter, a keeper having a current limiting device configured to select the operating point of the keeper and a heater. A magnetic field source is operatively associated with the thruster assembly for generating a magnetic field to control the discharge. A plasma discharge circuit creates a plasma and accelerates the plasma to produce thrust. A power supply is connected to the keeper and the plasma discharge circuit and is connected to the heater through a first switching device responsive to a predetermined condition for interrupting the power to the heater and simultaneously enabling the power supply to deliver power to the keeper and the plasma discharge circuit to initiate production of thrust.

In one embodiment, the current limiting device may include a second switching device configured to interrupt the current to the keeper. The current limiting device may include a resistor configured to select the operating point of the keeper. The current limiting device may be non-dissipative.

This invention further features a multi-functional power supply system for a Hall thruster including a thruster assembly for providing a plasma discharge and a cathode assembly for providing electrons. The cathode assembly includes an emitter, a keeper including a current limiting device, and a heater. A magnetic field source is operatively associated with the thruster assembly for generating a magnetic field to control the discharge. A plasma discharge circuit creates a plasma and accelerates the plasma to produce thrust. A power supply is connected to the keeper and the plasma discharge circuit and is connected to the heater through a switching device responsive to a predetermined condition for interrupting the power to said heater and simultaneously enabling the power supply to deliver power to the keeper, the plasma discharge circuit, the thruster assembly, and the magnetic field source to initiate production of thrust.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
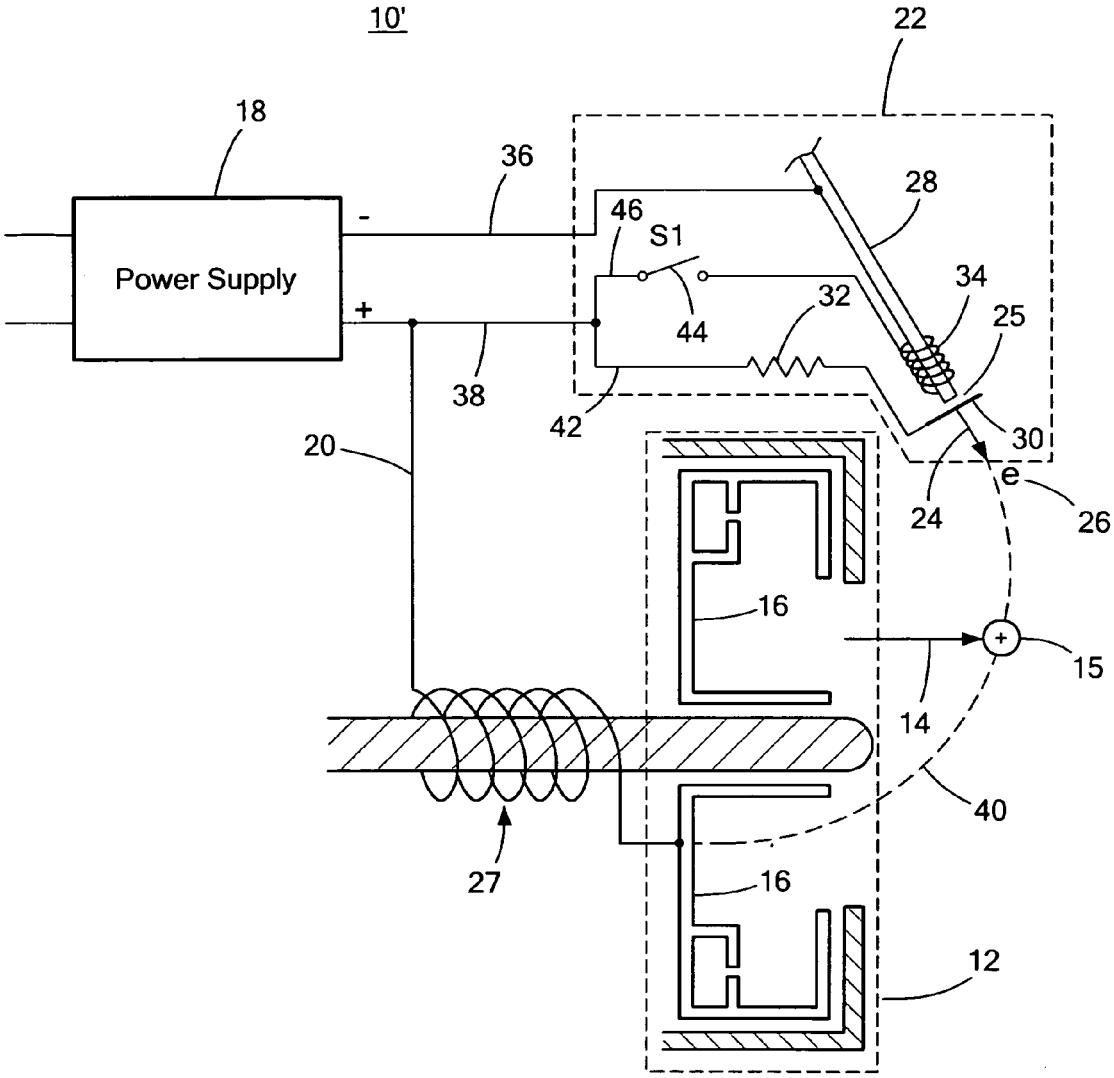
FIG. 1 is a side-sectional schematic diagram of the embodiment of the multi-functional power supply for a Hall thruster in accordance with this invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings.

There is shown in FIG. 1, multi-functional power supply system 10 for a Hall thruster of this invention including thruster assembly 12 for providing a plasma discharge that creates thrust 14. Plasma is created by ionizing propellant gas such as xenon. System 10 also includes cathode assembly 22 typically connected to power supply 18 on lines 36 and 38 to provide stream of primary electrons 24, such as electron 26. Cathode assembly 22 includes emitter 28, keeper 30, with current limiting device 32 (e.g., a resistor), and heater 34. Ideally, magnetic field source 27 is connected in series with plasma discharge circuit 40 and with cathode assembly 22 over line 20 and generates a magnetic field to control the plasma discharge impedance. Plasma discharge circuit 40 creates plasma (ionized gas) and accelerates the plasma, e.g., positively charged ion 15, to produce thrust 14. Details regarding the operation of the Hall thruster are known by those skilled in the art and are also disclosed in co-pending U.S. patent application Ser. No. 10/177,481, filed Jun. 21, 2002, incorporated herein by this reference.

Power supply 18 is connected by line 42 to keeper 30 and plasma discharge circuit 40 by line 46 to heater 34 through switching device 44. Switching device 44 is responsive to a predetermined condition, e.g., emitter temperature, time, heater voltage, and the like (discussed in further detail below) to interrupt the current from power supply 18 to heater 34 on line 46. When the current to heater 34 is interrupted, the output voltage of power supply 18 automatically increases to open circuit value (e.g., 300 V) which appears on keeper 30 and anode 16. This open circuit voltage (e.g. 300 V) is sufficient to energize or start the keeper discharge across gap 25, thus eliminating the need for a conventional keeper ignition circuit. Energized keeper 30 draws primary electrons 24 from emitter 28 establishing current through current limiting device 32 which reduces keeper 30 voltage to be below anode 16 voltage. Primary electron stream 24 then flows to anode 16 thus establishing plasma discharge circuit 40 for the production of thrust 14.

Thus, system 10 operates power supply 18 in a current limiting mode when the switching device 44 is closed and delivering maximum current to heater 34. System 10 then operates power supply 18 in a voltage control mode when switching device 44 is opened (in response to a predetermined condition) and delivers sufficient voltage to operate keeper 30 (as set by current limiting device 32), plasma discharge circuit 40, magnetic field source 27, and anode 16 of thruster assembly 12 to produce thrust 14. Ideally, magnetic field source 27 is in series with plasma discharge circuit 40. Magnetic field source 27 may include permanent magnets. Magnetic field source 27 may be connected to plasma discharge circuit 40 on the same side as anode 16, as shown in FIG. 1, however, this is not a necessary limitation of this invention, as magnetic field source 27 may be connected to plasma discharge circuit 40 on the same side as emitter 28.

In operation, when switching device 44 is closed, power is directed from power supply 18 to heater 34 on line 46. In this state, power supply 18 is in a current limiting mode and delivers maximum current (e.g., 6.0 A) to heater 34. The voltage across heater 34 (e.g., 6 V) is dictated by the resistance of heater 34 (e.g., 1 Ω) and the current supplied to it (e.g., 6.0 A). When switching device 44 is closed, the current to keeper 30 and plasma discharge circuit 40 is zero because neither keeper 30 or anode 16 have reached sufficient voltage to initiate plasma discharge circuit 40. When heater 34 reaches sufficient operating level, such as 1200° C., to generate electrons, (e.g., stream of primary electrons 24) switching device 44 is opened and interrupts the current to heater 34. Various devices can be used to determine the condition for opening switching device 44, discussed in further detail below. When switching device 44 is open, power is interrupted to heater 34 and power supply 18 goes out of the current limiting mode and into voltage control mode. In voltage control mode, voltage is delivered to keeper 30 and plasma discharge circuit 40 on line 42, as well as to anode 16 on line 20, and rapidly ramps up to a desired set point of keeper 30 (e.g., 250 V). During the voltage increase to keeper 30, keeper 30 breaks down (allowing electrons to flow across gap 25 between cathode 28 and keeper 30) and starts delivering a small amount of current (e.g., 83 mA at 250 V) through voltage limiting device 32. Current limiting device 32 is chosen to set the desired operating point of keeper 30, e.g., a 3000 Ω resistor at 83 mA sets the operation point of keeper 30 to about 250 V. The resistance value can be varied to achieve the desired keeper operating current and voltage. Once keeper 30 starts, there is sufficient voltage on anode 16 to initiate plasma discharge and the production of thrust 14.

Figure 2:
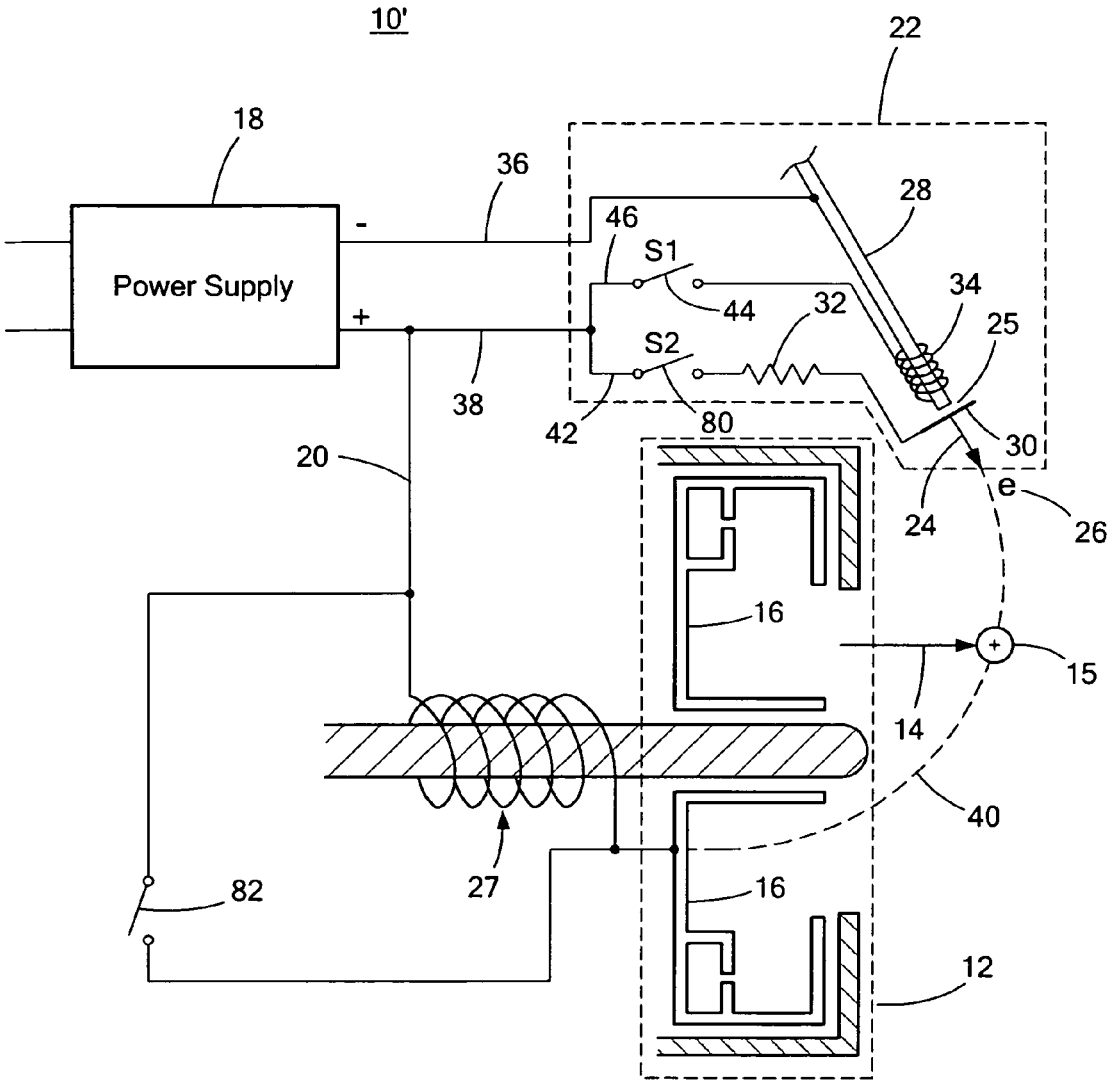
FIG. 2 is a side-sectional schematic diagram of another embodiment of the multi-functional power supply for a Hall thruster in accordance with this invention.

In one design, multi-functional power supply system 10', FIG. 2, where like parts have been given like numbers, includes second switching device 80 for interrupting the current to keeper 30. In this design, once the plasma discharge circuit 40 is established, switching device 80 is opened to interrupt the current to keeper 30 on line 42 and current limiting device 32 to eliminate power dissipation across current limiting device 32. Multi-function power supply system 10' may also include switching device 82 for regulating current through magnetic field source 27 to regulate plasma discharge impedance.

Figure 3:
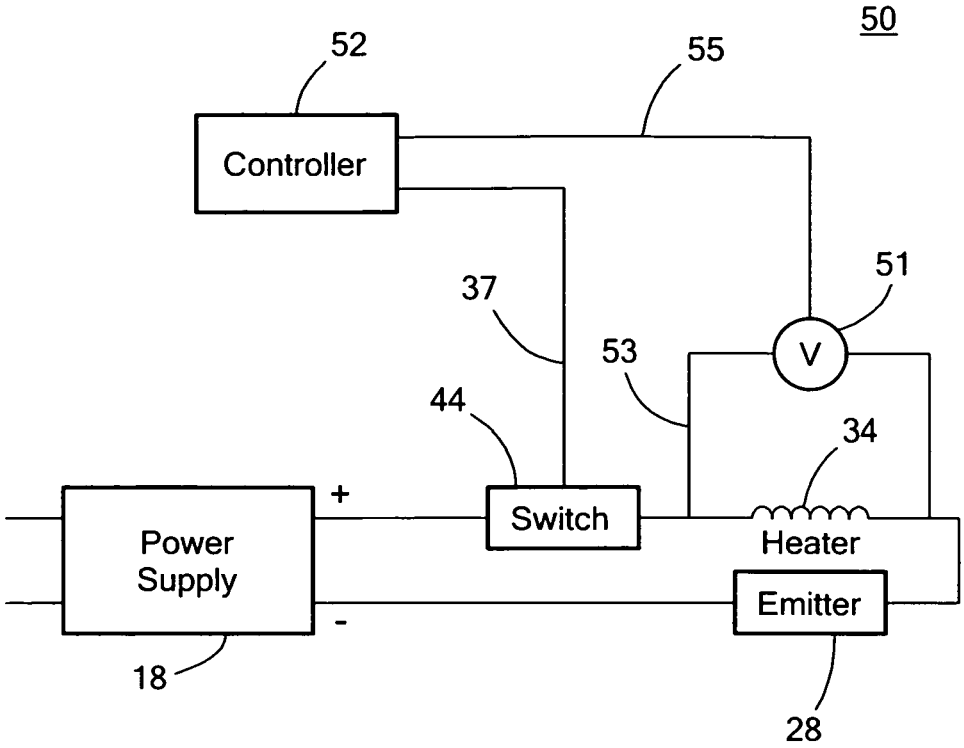
FIG. 3 is a schematic block diagram showing one example of a voltage monitoring system used to control the switching device shown in FIG. 1.

As discussed above, multi-functional power supply system 10, FIG. 1 of this invention may include a monitoring system for activating switching device 44 to interrupt power to heater 34 when a predetermined condition occurs. For example, monitoring system 50, FIG. 3, activates switching device 44 when, at a given current, a pre-determined voltage level, e.g., 6 V, is reached across heater 34. Monitoring system 50 includes voltage sensor 51 which measures the voltage across heater 34. The output of voltage sensor 51 is input to controller 52 on line 55. Controller 52 compares the voltage sensed by voltage sensor 51 to the pre-determined voltage level (e.g., 6.0 V) and when the voltage across heater 34 exceeds the predetermined voltage, controller 52 activates switching device 44 on line 37 to open switch device 44 and interrupt the power to heater 34.

Figure 4:
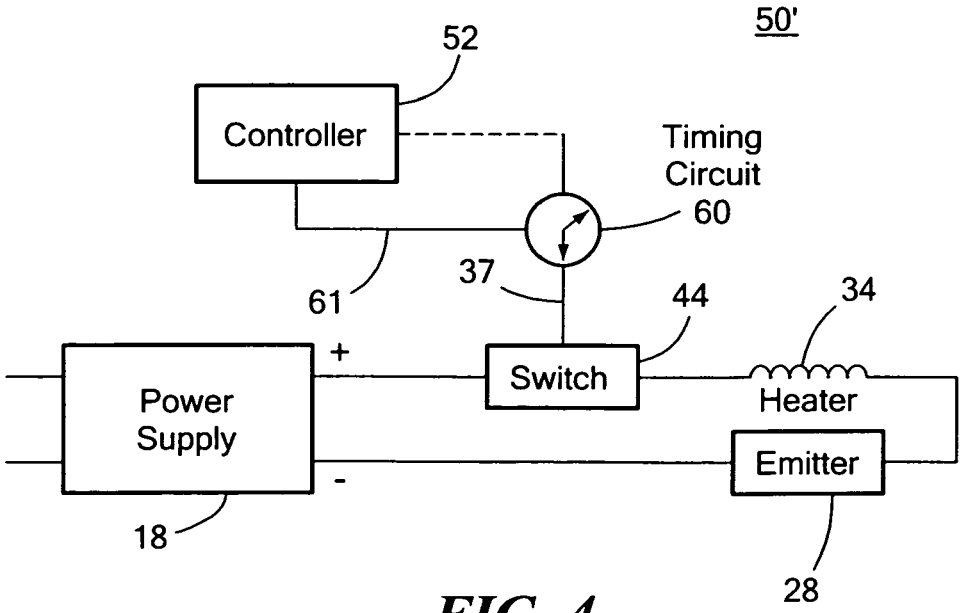
FIG. 4 is a schematic block diagram of one example of a timing monitoring system used to control the switching device shown in FIG. 1.

Monitoring circuit 50', FIG. 4, where like parts have been given like numbers, includes timing circuit 60 responsive to a predetermined time condition, e.g., approximately three minutes, which activates controller 52 to open switching device 44 on line 37 after the pre-determined amount of time has elapsed and interrupts the power to heater 34.

Figure 5:
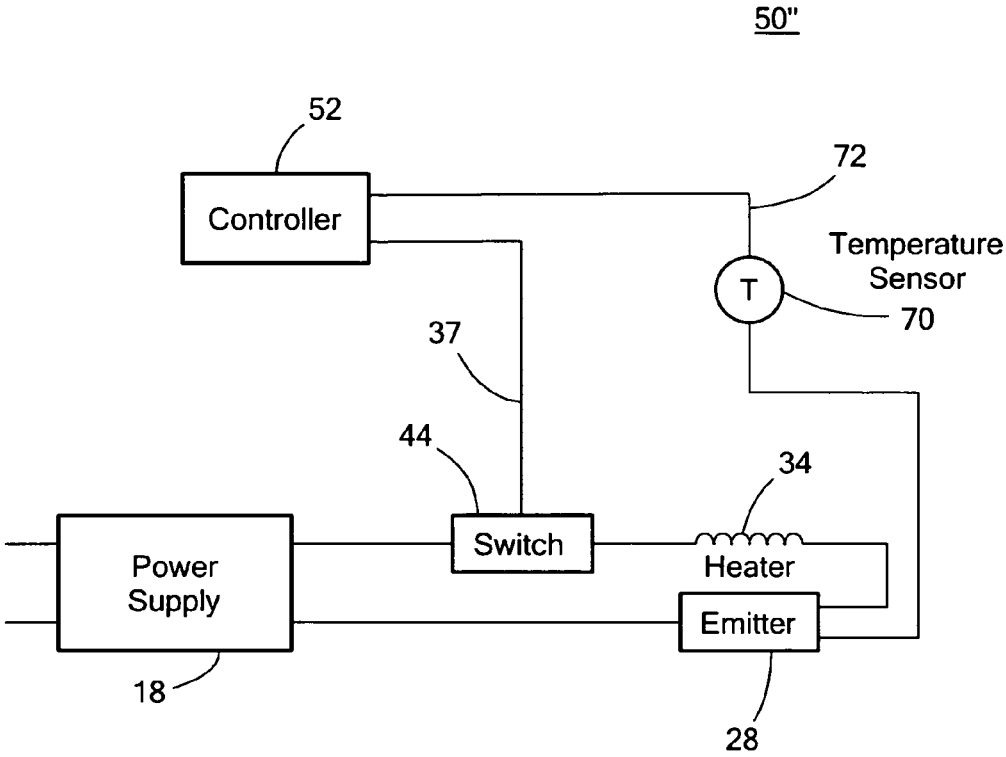
FIG. 5 is a schematic block diagram of one example of a temperature monitoring system used to control the switching device shown in FIG. 1.

Monitoring system 50", FIG. 5, where like parts have been given like numbers, is responsive to a predetermined temperature level, e.g., 1200° C. of emitter 28 to activate switching device 44 to interrupt the power to heater 34. Monitoring system 50 includes temperature sensor 70 for measuring the temperature of emitter 28. Controller 52 compares the temperature sensed by temperature sensor 70 to the pre-determined temperature and when the sensed temperature of emitter 28 exceeds the predetermined temperature, controller 52 opens switching device 44 on line 37 and interrupts the power to heater 34. Because heater 34 is generally in good thermal contact with emitter 28, temperature sensor 70 may also be placed on heater 34 instead of emitter 28.

Multi-functional power supply system 10, FIGS. 1 and 2 of this invention can provide power to heater 34, keeper 30, magnetic field source 27, plasma discharge circuit 30, and also ignite keeper 30 discharge across gap 25. The result is that the need for separate power supplies for these components is eliminated, hence significantly reducing the weight, volume, and cost of the Hall thruster system.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A multi-functional power supply system for a Hall thruster comprising:

a thruster assembly for providing a plasma discharge;

a cathode assembly for providing electrons, the cathode assembly having an emitter, a keeper including a current limiting device, and a heater;

a magnetic field source operatively associated with the thruster assembly for generating a magnetic field to control the discharge;

a plasma discharge circuit for creating a plasma and accelerating the plasma to produce thrust; and a power supply, connected to said keeper and said plasma discharge circuit and connected to said heater through a switching device, responsive to a predetermined condition for interrupting the power to said heater and simultaneously enabling said power supply to deliver power to said keeper and said plasma discharge circuit to initiate production of thrust.

2. The multi-functional power supply system of claim 1 in which said magnetic field source is in series with said discharge circuit and powered by said power supply.

3. The multi-functional power supply system of claim 1 in which said thruster assembly includes an anode and is in series with said magnetic field source.

4. The multi-functional power supply system of claim 1 in which said magnetic field source includes permanent magnets.

5. The multi-functional power supply system of claim 1 in which said system includes a monitoring system for activating said switching device when said predetermined condition occurs.

6. The multi-functional power supply system of claim 5 in which said predetermined condition is temperature and said monitoring system includes a temperature sensor.

7. The multi-functional power supply system of claim 5 in which said predetermined condition is time and said monitoring system includes a timing circuit.

8. The multi-functional power supply system of claim 5 in which said predetermined condition is voltage and said monitoring system includes a voltage sensor.

9. The multi-functional power supply system of claim 1 in which said power supply operates in a current control mode when said switching device is closed and conducting current to said heater and in a voltage control mode when said switching device is open and interrupting the current to said heater.

10. The multi-functional power supply system of claim 1 in which said current limiting device includes a resistor for selecting the operating point for said keeper.

11. The multi-functional power supply system of claim 1 in which said current limiting device is non-dissipative.

12. The multi-functional power supply system of claim 1 in which said current limiting device includes a second switching device for interrupting current to said keeper.

13. The multi-functional power supply system of claim 1 further including a switching device for regulating current through the magnetic field source for regulating plasma discharge impedance.

14. A multi-functional power supply system for a Hall thruster comprising:

a thruster assembly including an anode for providing a plasma discharge;

a cathode assembly for providing electrons, the cathode assembly having an emitter, a keeper including a current limiting device, and a heater;

a magnetic field source operatively associated with the thruster assembly for generating a magnetic field to control the discharge;

a plasma discharge circuit for creating a plasma and accelerating the plasma to produce thrust; and a power supply connected to said keeper and said plasma discharge circuit and connected to said heater through a switching device responsive to a predetermined condition for interrupting the power to said heater and simultaneously enabling said power supply to deliver power to said keeper and said discharge circuit to initiate production of thrust, said power supply operating in a current control mode when said switching device is conducting current and in a voltage control mode when said switching device has interrupted the current to said heater.

15. A multi-functional power supply system for a Hall thruster comprising:

a thruster assembly for providing a plasma discharge;

a cathode assembly for providing electrons, the cathode assembly having an emitter, a keeper including a current limiting device and a heater, said current limiting device configured to select the operating point of said keeper;

a magnetic field source operatively associated with the thruster assembly for generating a magnetic field to control the discharge;

a plasma discharge circuit for creating a plasma and accelerating the plasma to produce thrust; and a power supply connected to said keeper and said plasma discharge circuit and connected to said heater through a first switching device responsive to a predetermined condition for interrupting the power to said heater and simultaneously enabling said power supply to deliver power to said keeper and said plasma discharge circuit to initiate production of thrust.

16. The multi-functional power supply system for a Hall thruster of claim 15 in which said current limiting device includes a second switching device configured to interrupt the current to said keeper.

17. The multi-functional power supply system for a Hall thruster of claim 15 in which said current limiting device includes a resistor configured to select said operating point of said keeper.

18. The multi-functional power supply system of claim 15 in which said current limiting device is non-dissipative.

19. A multi-functional power supply system for a Hall thruster comprising:

a thruster assembly including an anode for providing a plasma discharge;

a cathode assembly for providing electrons, the cathode assembly having an emitter, a keeper including a current limiting device, and a heater;

a magnetic field source operatively associated with the thruster assembly for generating a magnetic field to control the discharge;

a plasma discharge circuit for creating a plasma and accelerating the plasma to produce thrust; and a power supply, connected to said keeper and said plasma discharge circuit and connected to said heater through a switching device, responsive to a predetermined condition for interrupting the power to said heater and simultaneously enabling said power supply to deliver power to said keeper, said plasma discharge circuit, said magnetic field source and said thruster assembly to initiate production of thrust.

* * * * *